US010373593B1

(12) United States Patent
Campfield

(10) Patent No.: US 10,373,593 B1
(45) Date of Patent: Aug. 6, 2019

(54) DETACHABLE NECK GUITAR ASSEMBLY

(71) Applicant: David Campfield, Festus, MO (US)

(72) Inventor: David Campfield, Festus, MO (US)

( * ) Notice: Subject to any disclaimer, the term of this patent is extended or adjusted under 35 U.S.C. 154(b) by 0 days.

(21) Appl. No.: 15/997,870

(22) Filed: Jun. 5, 2018

(51) Int. Cl.
*G10D 13/06* (2006.01)
*G10D 3/06* (2006.01)
*G10D 1/08* (2006.01)

(52) U.S. Cl.
CPC ..... *G10D 3/06* (2013.01); *G10D 1/08* (2013.01)

(58) Field of Classification Search
CPC ..... G10D 3/06
See application file for complete search history.

(56) References Cited

U.S. PATENT DOCUMENTS 424,097 A 3/1890 Cottrell
5,679,910 A 10/1997 Steinberger
5,886,272 A * 3/1999 Regenberg ..... G10D 3/06 84/291
7,687,698 B2 3/2010 Kim
7,816,592 B2 10/2010 Babicz
7,838,750 B2 11/2010 Steinberger
8,426,709 B2 * 4/2013 Zervas ..... G10D 3/06 84/293
9,368,092 B2 * 6/2016 Hooker ..... G10D 1/08
9,972,288 B2 * 5/2018 Baer ..... G10D 3/06
2014/0144306 A1 * 5/2014 Seal ..... G10D 1/005 84/291
2017/0178602 A1 6/2017 Baer
2018/0012578 A1 * 1/2018 Canivell Grifols ..... G10D 3/06

* cited by examiner

*Primary Examiner* — Robert W Horn

(57) ABSTRACT

A detachable neck guitar assembly for selectively positioning strings of a guitar includes a body and a neck. The body defines an interior space. A first coupler is coupled to the body and is positioned in the interior space equally distant from upper bouts of the body. A second coupler is coupled to the neck. The second coupler is complementary to the first coupler and is positioned to selectively couple to the first coupler to pivotally couple the neck to the body. The first coupler and the second coupler comprise a biaser. The biaser is positioned both to selectively pivot and to fixedly position the neck relative to the body. Stings that are coupled to and extend between the neck and the body are selectively positionable relative to a fret board is coupled to the neck.

10 Claims, 5 Drawing Sheets

DETACHABLE NECK GUITAR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to guitar assemblies and more particularly pertains to a new guitar assembly for selectively positioning strings of a guitar.

BRIEF SUMMARY OF THE INVENTION

An embodiment of the disclosure meets the needs presented above by generally comprising a body and a neck. The body defines an interior space. A first coupler is coupled to the body and is positioned in the interior space equally distant from upper bouts of the body. A second coupler is coupled to the neck. The second coupler is complementary to the first coupler and is positioned to selectively couple to the first coupler to pivotally couple the neck to the body. The first coupler and the second coupler comprise a biaser. The biaser is positioned both to selectively pivot and to fixedly position the neck relative to the body. Stings that are coupled to and extend between the neck and the body are selectively positionable relative to a fret board is coupled to the neck.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
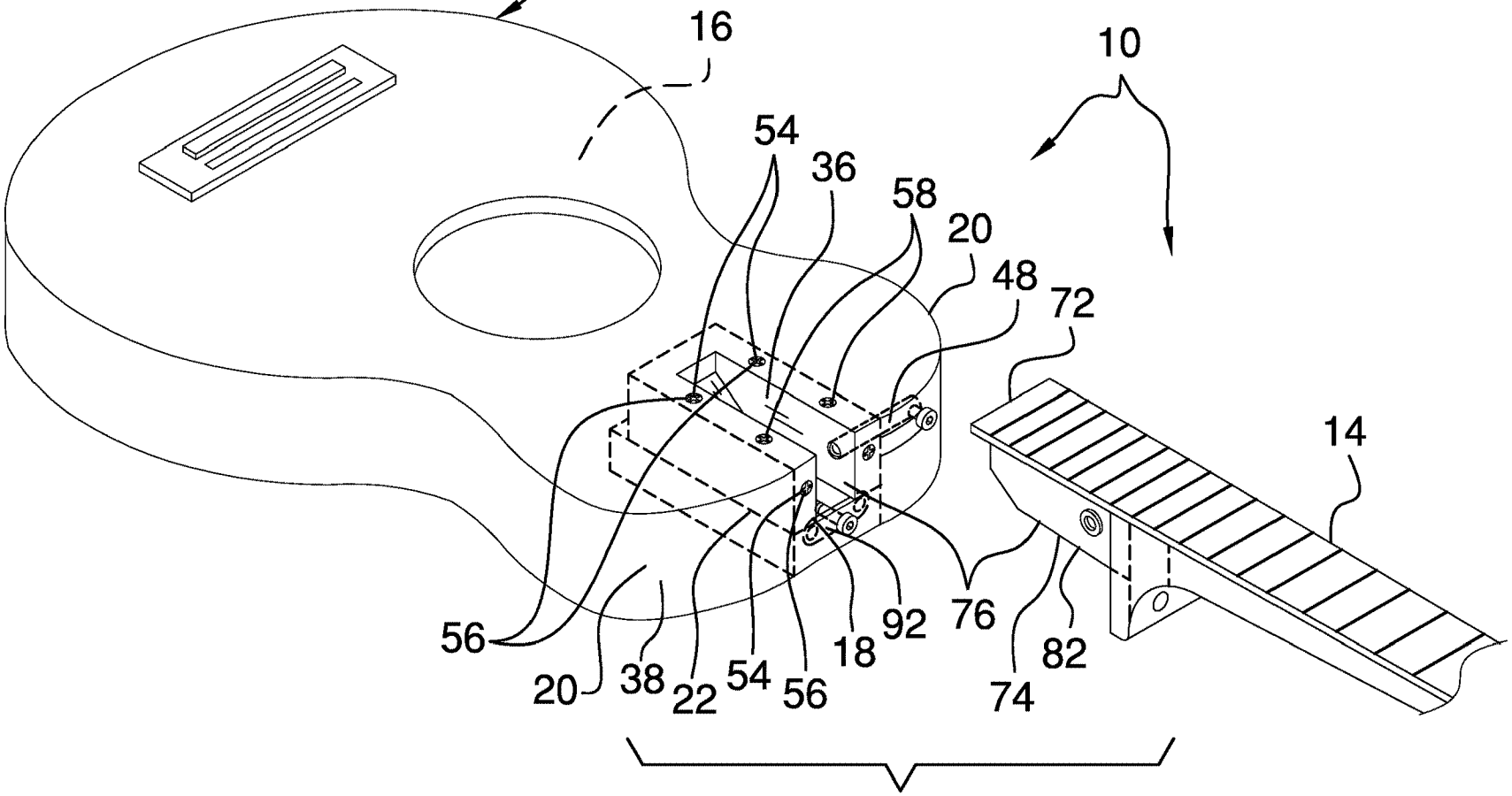
FIG. 1 is an isometric perspective view of a detachable neck guitar assembly according to an embodiment of the disclosure.
Figure 2:
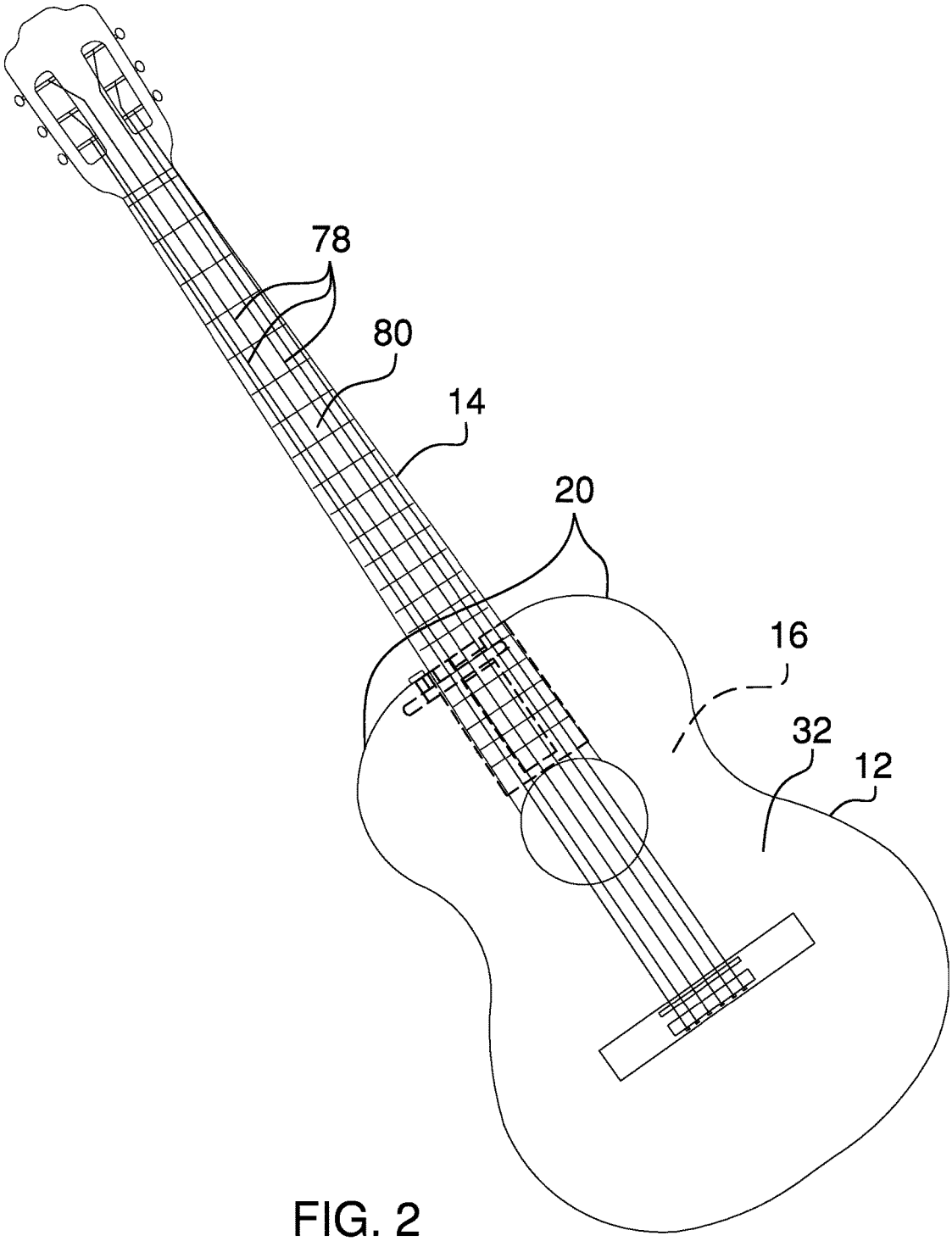
FIG. 2 is a top view of an embodiment of the disclosure.

With reference now to the drawings, and in particular to FIGS. 1 through 5 thereof, a new guitar assembly embodying the principles and concepts of an embodiment of the disclosure and generally designated by the reference numeral 10 will be described.

Figure 3:
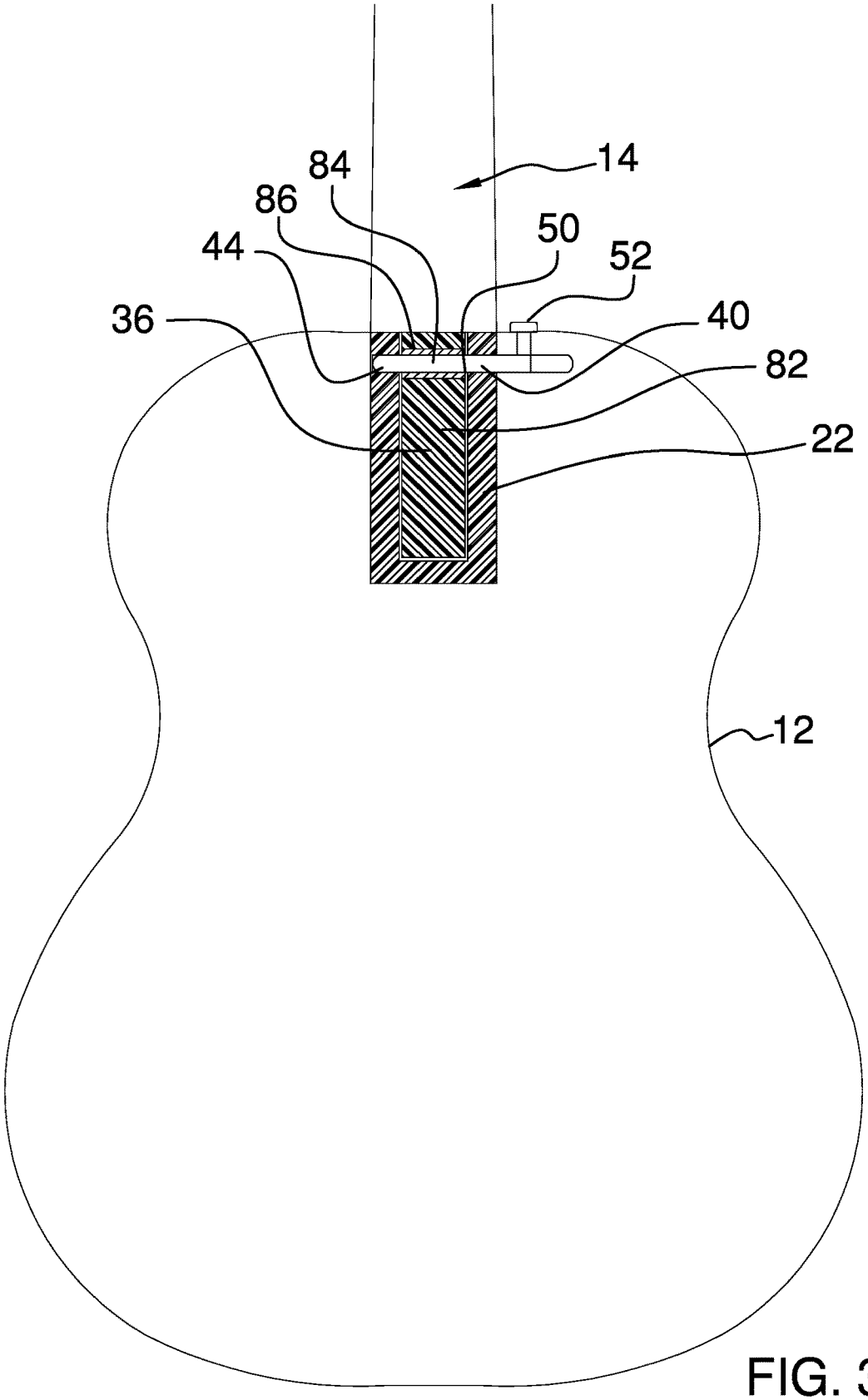
FIG. 3 is a bottom view of an embodiment of the disclosure.
Figure 4:
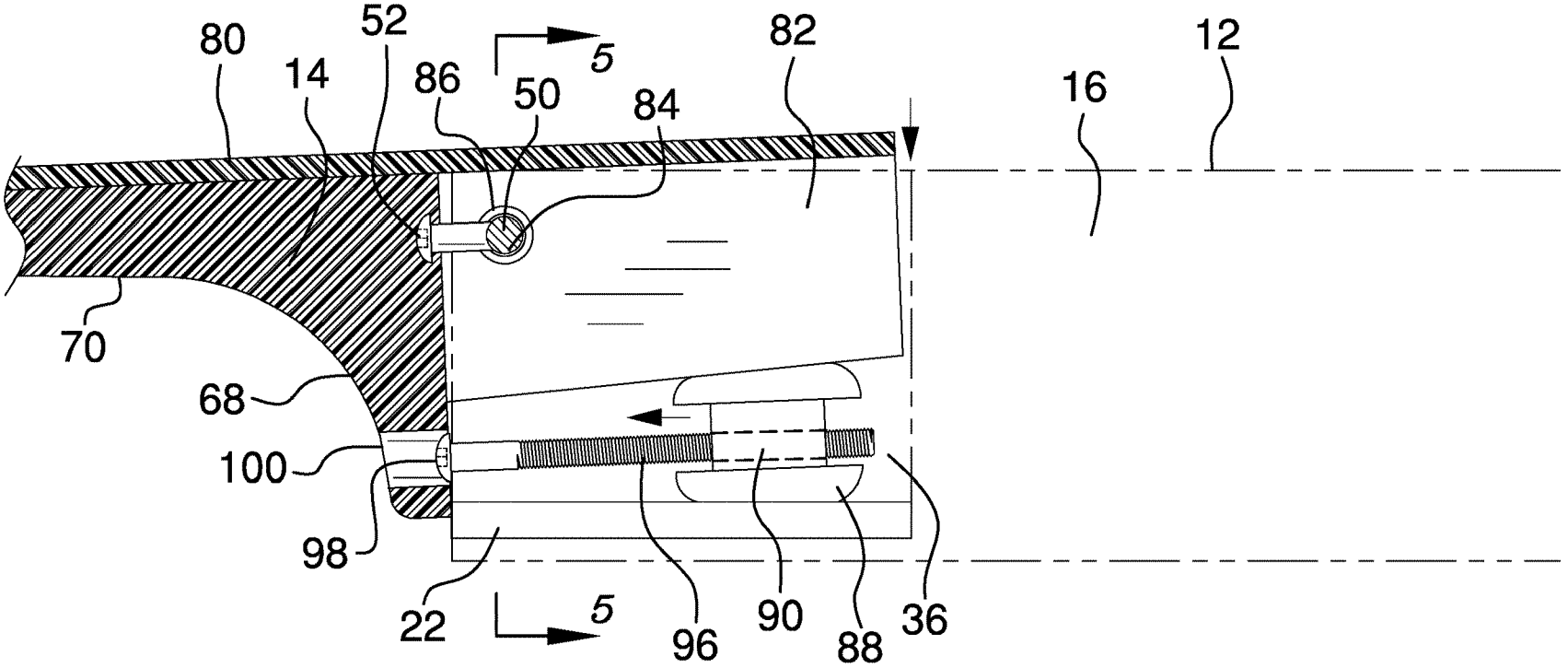
FIG. 4 is a cross-sectional view of an embodiment of the disclosure.
Figure 5:
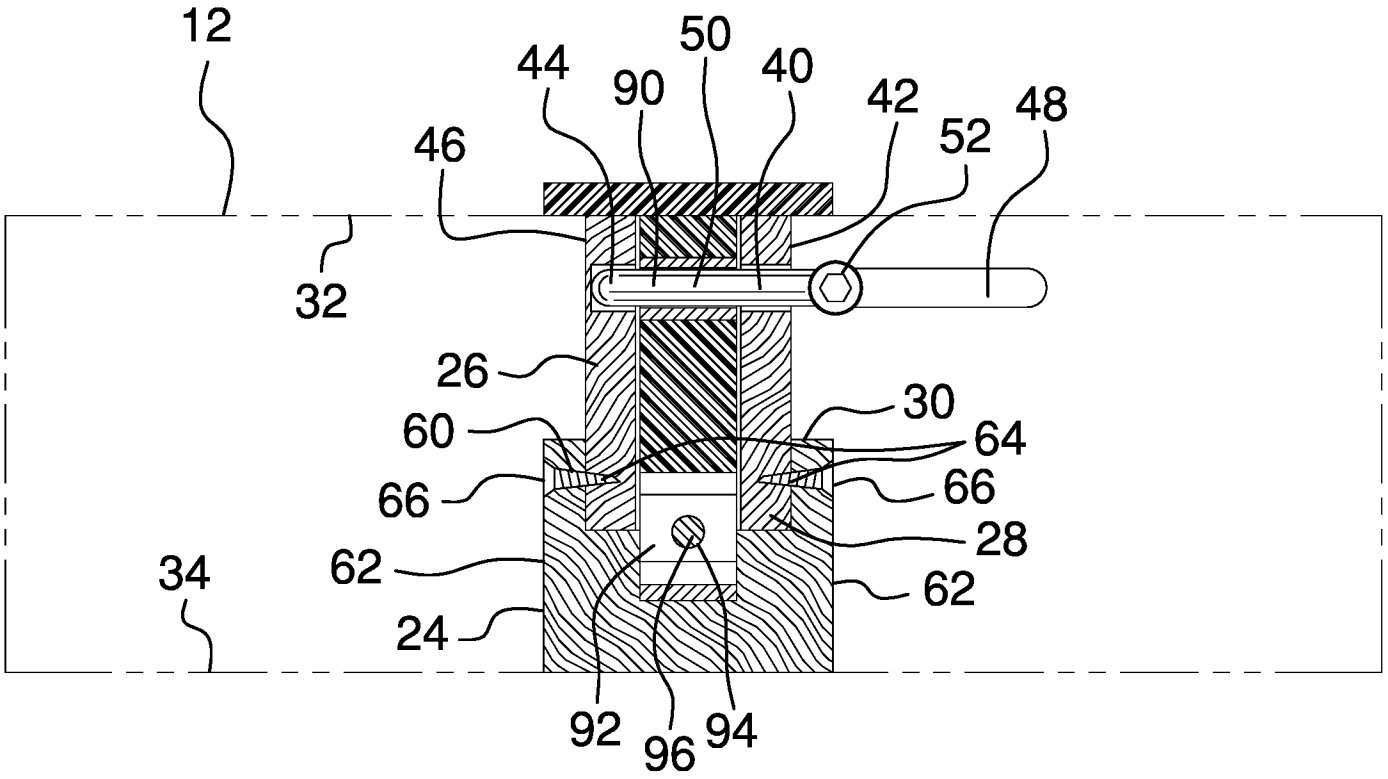
FIG. 5 is a cross-sectional view of an embodiment of the disclosure.

As best illustrated in FIGS. 1 through 5, the detachable neck guitar assembly 10 generally comprises a body 12 and a neck 14. The body 12 defines an interior space 16. A first coupler 18 is coupled to the body 12 and is positioned in the interior space 16 equally distant from upper bouts 20 of the body 12. The first coupler 18 comprises a first block 22. The first block 22 comprises a lower section 24 and an upper section 26, as shown in FIG. 5. A recess 28 is positioned in an upper face 30 of the lower section 24. The upper section 26 is complementary to and positioned in the recess 28. The upper section 26 abuts a soundboard 32 of the body 12 and the lower section 24 abuts a bottom 34 of the body 12.

A first slot 36 extends through a sidewall 38 and the soundboard 32 of the body 12 into the first block 22, as shown in FIG. 1. A first channel 40 is positioned through a first side 42 of the first block 22 and extends to the first slot 36. A second channel 44 is positioned in a second side 46 of the first block 22 and extends from the first slot 36. The second channel 44 is aligned with the first channel 40.

A second slot 48 is positioned through the sidewall 38. The second slot 48 extends from the first block 22 toward a respective upper bout 20 of the body 12. A pivot rod 50 is positioned in the first channel 40 and is selectively positionable though the first slot 36 and the second channel 44. A knob 52 is coupled to the pivot rod 50 and extends through the second slot 48. The knob 52 is configured to be grasped in digits of a hand of the user to selectively urge the pivot rod 50 through the first channel 40, through the first slot 36, and into the second channel 44.

A plurality of first holes 54 is positioned in the body 12, as shown in FIG. 1. The first holes 54 are counterbored. The plurality of first holes 54 comprises four first holes 54 that are positioned in the soundboard 32 and two first holes 54 that are positioned in a sidewall 38 of the body 12.

A plurality of second holes 56 is positioned in the upper section 26. Each second hole 56 is aligned with an associated first hole 54. Each of a plurality of first screws 58 is threadedly inserted into a respective first hole 54 and the associated second hole 56 to couple the upper section 26 to the body 12.

Each of a plurality of third holes 60 is positioned in a respective opposing face 62 of the lower section 24 and extends to the recess 28, as shown in FIG. 5. The plurality of third holes 60 comprises four third holes 60 that are positioned two-apiece in each opposing face 62 of the lower section 24.

A plurality of fourth holes 64 is positioned in the upper section 26. Each fourth hole 64 is aligned with an associated third hole 60. Each of a plurality of second screws 66 screw is threadedly inserted into a respective third hole 60 and the associated fourth hole 64 to couple the lower section 24 to the upper section 26. The present invention also anticipates the first coupler 18 being integral to the body 12.

A heel 68 is coupled to a lower face 70 proximate to a terminus 72 of the neck 14 as shown in FIG. 1. A second coupler 74 is coupled to the neck 14. The second coupler 74 is complementary to the first coupler 18. The second coupler 74 is positioned to selectively couple to the first coupler 18 to pivotally couple the neck 14 to the body 12. A user is positioned to select a desired neck 14 and a desired body 12 and to couple the desired neck 14 to the desired body 12.

The first coupler 18 and the second coupler 74 comprise a biaser 76. The biaser 76 is positioned both to selectively pivot and to fixedly position the neck 14 relative to the body 12. Stings 78 that are coupled to and extend between the neck 14 and the body 12 are selectively positionable relative to a fret board 80 that is coupled to the neck 14. The user would utilize the biaser 76 to pivot the neck 14 relative to the body 12 to position the strings 78 at a desired distance from the fret board 80. The biaser 76 fixedly positions the neck 14 relative to the body 12 to maintain the strings 78 at the desired distance from the fret board 80.

The second coupler 74 comprises a second block 82 that is coupled to the lower face 70 of the neck 14. The second block 82 extends from the heel 68 to the terminus 72 of the neck 14, as shown in FIG. 4. The second block 82 tapers from the heel 68 to the terminus 72. The second block 82 is complementary to and selectively positionable in the first slot 36 so that the heel 68 abuts the sidewall 38.

A third channel 84 is positioned through the second block 82 proximate to the heel 68. The third channel 84 is positioned to insert the pivot rod 50 so that the pivot rod 50 is positioned through the first channel 40, the second channel 44, and the third channel 84 to pivotally couple the neck 14 to the body 12, as shown in FIGS. 3 and 5. A bushing 86 is coupled to the second block 82 and is positioned in the third channel 84. The bushing 86 is positioned to facilitate movement of the pivot rod 50 within the third channel 84.

The biaser 76 comprises a wedge 88 that is positioned in the first slot 36 between the first block 22 and the second block 82, as shown in FIG. 4. The wedge 88 is tapered so that the wedge 88 is complementary to the second block 82. A fourth channel 90 is positioned through the wedge 88. The fourth channel 90 is threaded.

A plate 92 is coupled to the sidewall 38 and extends across the first slot 36 proximate to the bottom 34 of the body 12, as shown in FIG. 1. An orifice 94 is positioned through the plate 92. The orifice 94 is aligned with the fourth channel 90. A bolt 96 is positioned through the orifice 94 and is threadedly inserted into the fourth channel 90 so that a head 98 of the bolt 96 abuts the plate 92 as shown in FIG. 4. The bolt 96 is positioned to be selectively rotated to urge the wedge 88 toward the head 98 of the bolt 96 to pivot the neck 14 relative to the body 12 and to selectively position the stings 78 relative to the fret board 80.

An access channel 100 is positioned in the heel 68, as shown in FIG. 4. The access channel 100 is aligned with the head 98 of the bolt 96. The access channel 100 is configured to insert a tool to rotate the bolt 96.

In use, the second block 82 is positioned in the first slot 36 so that the heel 68 abuts the sidewall 38. The knob 52 is used to urge the pivot rod 50 through the first channel 40, through the third channel 84, and into the second channel 44 to pivotally couple the neck 14 to the body 12. The tool is inserted through the access channel 100 to rotate the bolt 96 to urge the wedge 88 toward the head 98 of the bolt 96 to pivot the neck 14 relative to the body 12 to position the strings 78 at the desired distance from the fret board 80. The user ceases rotation of the bolt 96 to fixedly position the neck 14 relative to the body 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A detachable neck guitar assembly comprising:

a body defining an interior space;

a first coupler coupled to said body and positioned in said interior space equally distant from upper bouts of said body;

a neck;

a second coupler coupled to said neck, said second coupler being complementary to said first coupler wherein said second coupler is positioned for selectively coupling to said first coupler for pivotally coupling said neck to said body; and said first coupler and said second coupler comprising a biaser wherein said biaser is positioned for selectively pivoting and fixedly positioning said neck relative to said body wherein stings coupled to and extending between said neck and said body are selectively positionable relative to a fret board coupled to said neck.

2. The assembly of claim 1, further comprising:

a heel coupled to a lower face proximate to a terminus of said neck;

said first coupler comprising:

a first block, a first slot extending through a sidewall and a soundboard of said body into said first block, a first channel positioned through a first side of said first block and extending to said first slot, a second channel positioned in a second side of said first block and extends from said first slot, said second channel being aligned with said first channel, a second slot positioned through said sidewall, said second slot extending from said first block toward a respective said upper bout of said body, a pivot rod positioned in said first channel and selectively positionable though said first slot and said second channel, and a knob coupled to said pivot rod and extending through said second slot wherein said knob is configured for grasping in digits of a hand of a user for selectively urging said pivot rod through said first channel, through said first slot, and into said second channel; and said second coupler comprising:

a second block coupled to said lower face of said neck, said second block extending from said heel to said terminus of said neck, said second block tapering from said heel to said terminus, said second block being complementary to and selectively positionable in said first slot such that said heel abuts said sidewall, and a third channel positioned through said second block proximate to said heel wherein said third channel is positioned for inserting said pivot rod such that said pivot rod is positioned through said first channel, said second channel, and said third channel for pivotally coupling said neck to said body.

3. The assembly of claim 2, further including a bushing coupled to said second block and positioned in said third channel wherein said bushing is positioned for facilitating movement of said pivot rod within said third channel.

4. The assembly of claim 2, further including said biaser comprising:

a wedge positioned in said first slot between said first block and said second block, said wedge being tapered such that said wedge is complementary to said second block;

a fourth channel positioned through said wedge, said fourth channel being threaded;

a plate coupled to said sidewall and extending across said first slot proximate to a bottom of said body;

an orifice positioned through said plate, said orifice being aligned with said fourth channel; and a bolt positioned through said orifice and threadedly inserted into said fourth channel such that a head of said bolt abuts said plate wherein said bolt is positioned for selectively rotating for urging said wedge toward said head of said bolt for pivoting said neck relative to said body for selectively positioning said stings relative to said fret board.

5. The assembly of claim 2, further comprising:

said first block comprising:

a lower section, a recess positioned in an upper face of said lower section, and an upper section complementary to and positioned in said recess such that said upper section abuts said soundboard of said body and said lower section abuts a bottom of said body;

a plurality of first holes, each said first hole being positioned in said body;

a plurality of second holes positioned in said upper section, each said second hole being aligned with an associated said first hole;

a plurality of first screws, each said first screw being threadedly inserted into a respective said first hole and said associated said second hole for coupling said upper section to said body;

a plurality of third holes, each said third hole being positioned in a respective opposing face of said lower section and extending to said recess;

a plurality of fourth holes positioned in said upper section, each said fourth hole being aligned with an associated said third hole; and a plurality of second screws, each said second screw being threadedly inserted into a respective said third hole and said associated said fourth hole for coupling said lower section to said upper section.

6. The assembly of claim 5, further including said first holes being counterbored.

7. The assembly of claim 5, further including said plurality of first holes comprising four said first holes positioned in said soundboard and two said first holes positioned in said sidewall of said body.

8. The assembly of claim 5, further including said plurality of third holes comprising four said third holes positioned two-apiece in each said opposing face of said lower section.

9. The assembly of claim 4, further including an access channel positioned in said heel, said access channel being aligned with said head of said bolt wherein said access channel is configured for inserting a tool for rotating said bolt.

10. A detachable neck guitar assembly comprising:

a body defining an interior space;

a first coupler coupled to said body and positioned in said interior space equally distant from upper bouts of said body, said first coupler comprising:

a first block, said first block comprising:

a lower section, a recess positioned in an upper face of said lower section, and an upper section complementary to and positioned in said recess such that said upper section abuts a soundboard of said body and said lower section abuts a bottom of said body, a first slot extending through said sidewall and said soundboard of said body into said first block, a first channel positioned through a first side of said first block and extending to said first slot, a second channel positioned in a second side of said first block and extends from said first slot, said second channel being aligned with said first channel, a second slot positioned through said sidewall, said second slot extending from said first block toward a respective said upper bout of said body, a pivot rod positioned in said first channel and selectively positionable though said first slot and said second channel, and a knob coupled to said pivot rod and extending through said second slot wherein said knob is configured for grasping in digits of a hand of a user for selectively urging said pivot rod through said first channel, through said first slot, and into said second channel;

a plurality of first holes, each said first hole being positioned in said body, said first holes being counterbored, said plurality of first holes comprising four said first holes positioned in said soundboard and two said first holes positioned in a sidewall of said body;

a plurality of second holes positioned in said upper section, each said second hole being aligned with an associated said first hole;

a plurality of first screws, each said first screw being threadedly inserted into a respective said first hole and said associated said second hole for coupling said upper section to said body;

a plurality of third holes, each said third hole being positioned in a respective opposing face of said lower section and extending to said recess, said plurality of third holes comprising four said third holes positioned two-apiece in each said opposing face of said lower section;

a plurality of fourth holes positioned in said upper section, each said fourth hole being aligned with an associated said third hole;

a plurality of second screws, each said second screw being threadedly inserted into a respective said third hole and said associated said fourth hole for coupling said lower section to said upper section;

a neck;

a heel coupled to a lower face proximate to a terminus of said neck;

a second coupler coupled to said neck, said second coupler being complementary to said first coupler wherein said second coupler is positioned for selectively coupling to said first coupler for pivotally coupling said neck to said body, said first coupler and said second coupler comprising a biaser wherein said biaser is positioned for selectively pivoting and fixedly positioning said neck relative to said body wherein stings coupled to and extending between said neck and said body are selectively positionable relative to a fret board coupled to said neck;

said second coupler comprising:

a second block coupled to said lower face of said neck, said second block extending from said heel to said terminus of said neck, said second block tapering from said heel to said terminus, said second block being complementary to and selectively positionable in said first slot such that said heel abuts said sidewall, a third channel positioned through said second block proximate to said heel wherein said third channel is positioned for inserting said pivot rod such that said pivot rod is positioned through said first channel, said second channel, and said third channel for pivotally coupling said neck to said body, and a bushing coupled to said second block and positioned in said third channel wherein said bushing is positioned for facilitating movement of said pivot rod within said third channel;

said biaser comprising:

a wedge positioned in said first slot between said first block and said second block, said wedge being tapered such that said wedge is complementary to said second block, a fourth channel positioned through said wedge, said fourth channel being threaded, a plate coupled to said sidewall and extending across said first slot proximate to said bottom of said body, an orifice positioned through said plate, said orifice being aligned with said fourth channel, and a bolt positioned through said orifice and threadedly inserted into said fourth channel such that a head of said bolt abuts said plate wherein said bolt is positioned for selectively rotating for urging said wedge toward said head of said bolt for pivoting said neck relative to said body for selectively positioning said stings relative to said fret board; and an access channel positioned in said heel, said access channel being aligned with said head of said bolt wherein said access channel is configured for inserting a tool for rotating said bolt.

* * * * *